US005460551A

United States Patent [19]

Beres

[11] Patent Number: 5,460,551

[45] Date of Patent: Oct. 24, 1995

[54] PEDAL-POWERED KAYAK

[76] Inventor: Jeffrey W. Beres, 2305 E. Lake Sammamish Pl. SE., Issaquah, Wash. 98027

[21] Appl. No.: 286,882

[22] Filed: Aug. 5, 1994

[51] Int. Cl.[6] ..... B63H 16/20

[52] U.S. Cl. ..... 440/27; 114/347

[58] Field of Search ..... 114/347, 144 R, 114/363; 440/21, 26, 27, 31

[56] References Cited

U.S. PATENT DOCUMENTS

| | | | |
|---|---|---|---|
| D. 292,694 | 11/1987 | Panyik | D12/306 |
| D. 321,854 | 11/1991 | Foley et al. | D12/306 |
| D. 326,442 | 5/1992 | Shutt | D12/306 |
| 2,273,327 | 2/1942 | Metaxas | 440/31 |
| 3,150,386 | 9/1964 | Bastien | 114/347 |
| 3,903,834 | 9/1975 | Arevalo | 115/24 |
| 4,171,675 | 10/1979 | Thompson | 115/16 |
| 4,459,116 | 7/1984 | Moore | 440/31 |
| 4,576,580 | 3/1986 | Gulko | 440/21 |
| 4,657,514 | 4/1987 | Chun | 440/31 |
| 4,698,034 | 10/1987 | Anthonijsz | 440/27 |
| 4,746,312 | 5/1988 | Teodosio et al. | 440/21 |
| 4,772,237 | 9/1988 | Zalkauskas | 440/96 |
| 4,789,365 | 12/1988 | Jones | 440/21 |
| 4,795,381 | 1/1989 | Willems | 440/26 |
| 4,891,024 | 1/1990 | Benjamin | 440/28 |
| 4,960,396 | 10/1990 | Stolzer | 440/21 |
| 4,968,274 | 11/1990 | Gregory | 440/27 |
| 5,011,441 | 4/1991 | Foley et al. | 440/30 |
| 5,042,416 | 8/1991 | Arcouette | 114/347 |
| 5,127,855 | 7/1992 | Heywood | 440/14 |
| 5,145,424 | 9/1992 | Han | 440/13 |
| 5,178,088 | 1/1993 | Howard | 114/270 |
| 5,194,024 | 3/1993 | Shiraki | 440/29 |
| 5,217,398 | 6/1993 | Meron et al. | 440/26 |

*Primary Examiner*—Jesús D. Sotelo
*Attorney, Agent, or Firm*—Seed and Berry

[57] ABSTRACT

A kayak having a cockpit containing a seat and a set of rotatable of pedals, the kayak propelled by a propeller, the propeller driven via a linkage by the set of rotatable pedals. Preferably, the rotatable pedals are mobile fore and aft substantially parallel to a center line of the kayak, and the drive shaft to the propeller is able to be extended and retracted to maintain the transmission of power and rotation from the rotatable pedals to the propeller. Also preferably, the cockpit containing the seat is molded into an upper deck of the kayak such that a hip of a user is substantially fully below the upper deck, and the cockpit has substantially no overhangs, such that, after capsizing and righting of the kayak in water, substantially no water is retained in the cockpit. The kayak also preferably includes a torque-tube steering system that permits a user to steer with either hand, and without interrupting the propulsion of the kayak on the water. The kayak also preferably includes a removable insert sized to fit a cargo hatch in an upper deck of the kayak, the insert also sized to seat a child or animal.

9 Claims, 3 Drawing Sheets

Fig. 1
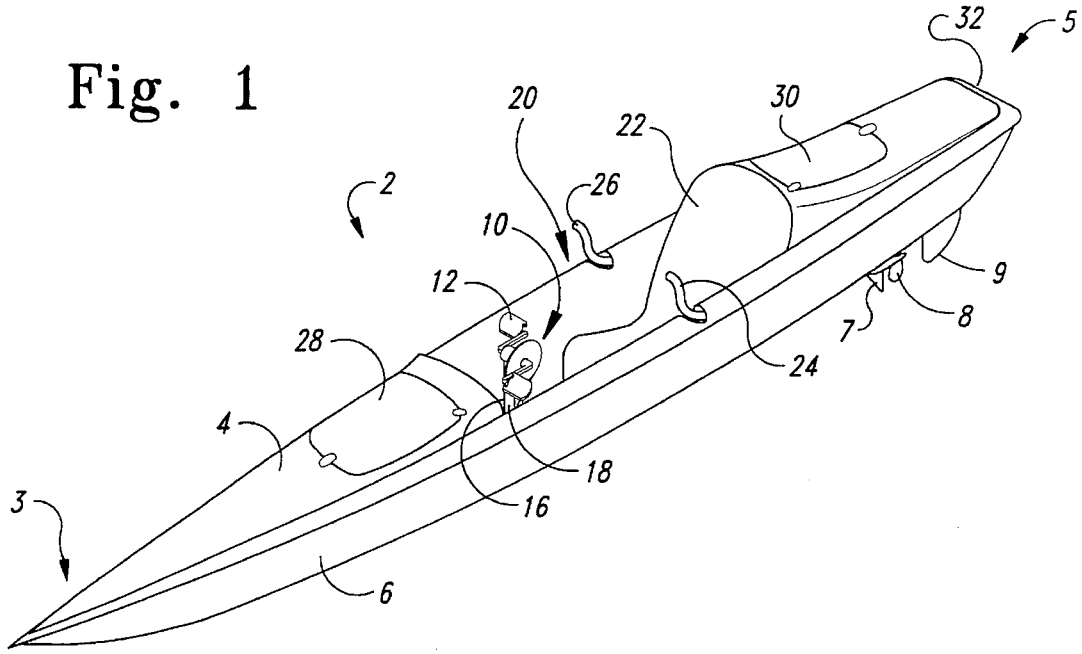
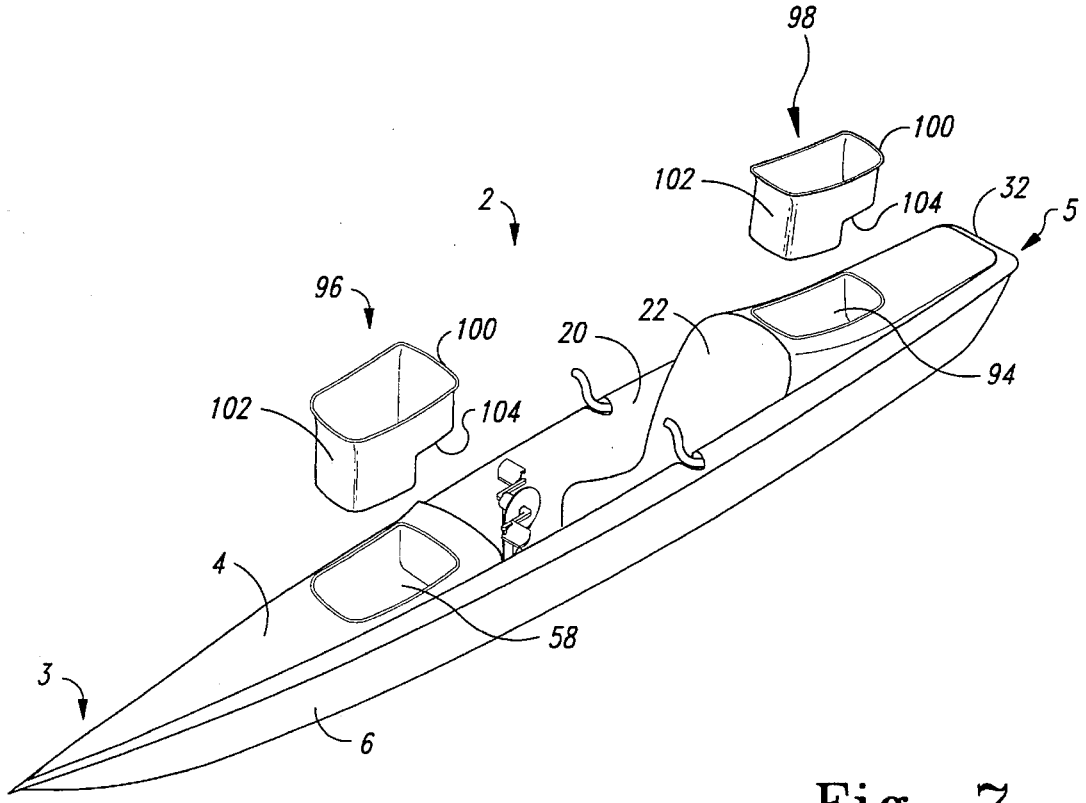
Fig. 7

Fig. 4
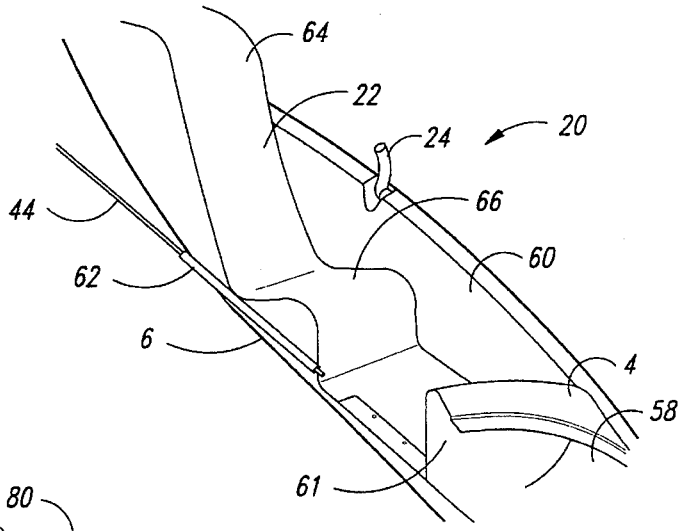
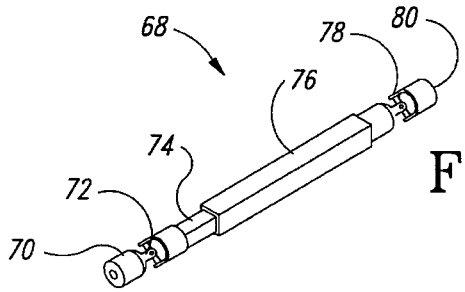
Fig. 5A
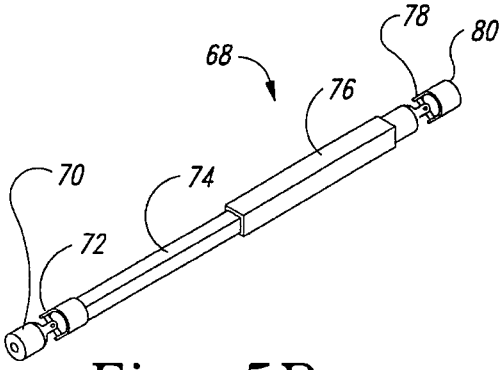
Fig. 5B
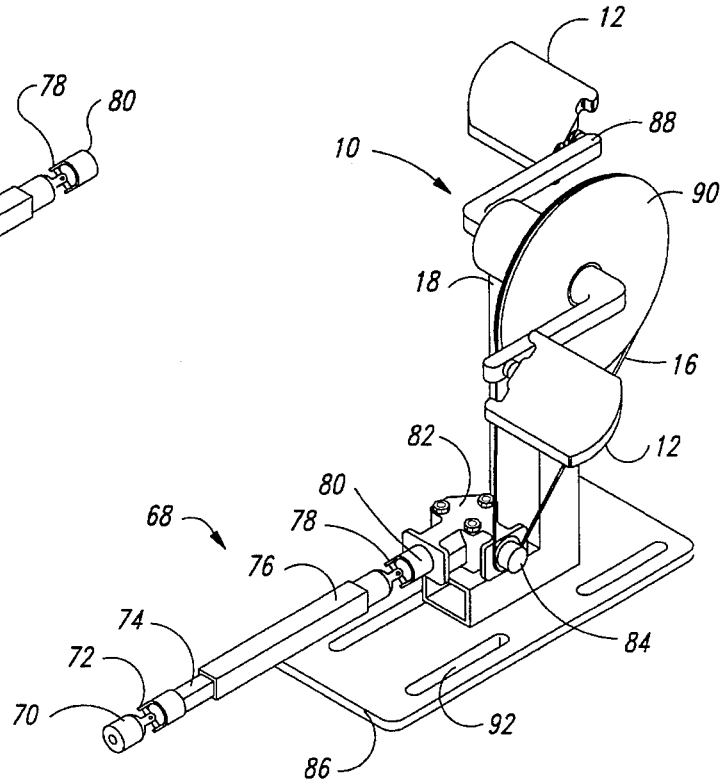
Fig. 6

PEDAL-POWERED KAYAK

TECHNICAL FIELD

The field of the present invention is kayaks.

BACKGROUND OF THE INVENTION

Kayaks are traditionally propelled by the use of a paddle (or oar), which is manipulated by the hands and arms of a user. One disadvantage of using a paddle for propulsion is that the blade of the paddle is an inefficient means of providing thrust. Further, the user of the kayak has limited power available in the arms and hands relative to the legs, and therefore the user will tend to tire easily. Because of both the inefficient nature of the paddle and the limited power available through the arms and hands of the user, the traditional kayak has a limited boat speed, particularly when traveling for an extended distance. Another disadvantage with the use of a paddle is that the paddle requires the use of both hands for paddling, steering, and other manipulation. Thus, both hands of the user are occupied at all times that propulsion is provided to the kayak, and the user is unable to grasp and hold items while providing propulsion to the kayak. Therefore, the user is unable to move materials about in the cockpit, or to engage in non-kayak specific activities such as photography or fishing.

In alternative approaches, such as in U.S. Pat. Nos. 4,968,274 and 5,194,024, pedals and propellers have been attached to catamaran-type, pontoon watercraft, and even to surfboards. However, the catamaran-type designs are bulky, typically require disassembly and assembly for transport to and from a body of water, and are difficult to return to upright in the event the watercraft capsizes. Surfboard-type main bodies have a limited buoyancy and limited stability, thereby greatly increasing the likelihood of capsizing. Further, both of these types of watercraft leave the user of the watercraft open to the elements, and typically subject to continual splashing. These watercraft also are typically capable of attaining only very limited speeds.

Thus, there has gone unmet a need for a watercraft providing a stable platform, a relatively dry cockpit and superior speed and endurance. The present invention provides these and other related advantages.

SUMMARY OF THE INVENTION

In one aspect, the present invention provides a monohull watercraft comprising a kayak having a cockpit containing a seat located such that a hip of a user is substantially fully below an upper deck of the kayak, the cockpit also containing a set of rotatable of pedals, the kayak propelled by a propeller that is driven via a linkage by the set of rotatable pedals. In a preferred embodiment, the stem of the kayak is truncated behind the seat substantially perpendicular to a center line extending along the kayak, to provide a transom. Further preferably, the kayak has a cruising speed of at least about 6 miles per hour, and even further preferably at least about 7 miles per hour, when the rotatable pedals are rotated at about 68 rpm to rotate the propeller at about 520 rpm, and the propeller has three blades, each blade with a pitch of about 14 inches, a width of about 1.75 inches, and a length of about 4 inches to provide a diameter of about 8.5 inches. These dimensions also describe a preferred propeller for the kayak.

In one embodiment, the kayak, and particularly the truncated embodiment discussed herein, has a width of about one-fifth to about one-seventh of the length of the kayak. Preferably, the width of the kayak is about one-sixth of the length. In an alternative preferred embodiment, the width is about 27 inches and the length is about 18 feet.

In another embodiment, the kayak includes a linkage comprising a bevel gear set capable of transmitting power and rotation at about a perpendicular angle from the pedals to a drive shaft attached to the propeller, the linkage preferably does not include a flexible belt transmitting rotation at an angle other than about 0° or 180°. Also preferably, the rotatable pedals are mobile fore and aft substantially parallel to a center line of the kayak, and the linkage includes a drive shaft leading to the propeller, the drive shaft able to be extended and retracted to maintain the transmission of power and rotation from the rotatable pedals to the propeller. The provision of fore-and-aft mobile pedals is particularly useful where the seat in the cockpit is molded into an upper deck of the kayak, or is otherwise stationary. Further preferably, the cockpit has substantially no overhang in the seat, or in gunwales or front, whereby, after capsizing and righting of the kayak in water, substantially no water is retained in the cockpit. It is also preferred that the bottom of the seat is located below the waterline of the kayak.

In a further embodiment, the kayak further comprises a steering mechanism comprising: a right handle located on a right side of the seat, the right handle protruding through an upper deck of the kayak, the right handle attached at a first end of a right rigid, elongated element running substantially parallel to a center line of the kayak, a second end of the right rigid, elongated element attached to a first end of a right connecting rod, the right rigid, elongated element connected to the right connecting rod at a first point away from the central axis of the right rigid, elongated element, such that upon rotation of the right rigid, elongated element the connecting rod is moved closer to or away from the center line of the kayak, the right connecting rod attached at a second end to a rudder and capable of manipulating the angle of the rudder relative to the center line; and a left handle located on a left side of the seat, the left handle protruding through the upper deck, the left handle attached at a first end of a left rigid, elongated element running substantially parallel to the center line, a second end of the left rigid, elongated element attached to a first end of a left connecting rod, the left rigid, elongated element connected to the left connecting rod at a second point away from the central axis of the left rigid, elongated element, such that upon rotation of the left rigid, elongated element the connecting rod is moved closer to or away from the center line, the left connecting rod attached at the second end to the rudder and capable of manipulating the angle of the rudder relative to the center line.

In still another embodiment, the kayak includes the pedal-driven propeller discussed herein and the rigid steering system discussed herein.

In yet another embodiment, the kayak further comprises a removable insert sized to fit a cargo hatch in an upper deck of the kayak, the removable insert also sized to permit a child or animal to sit in the removable insert. This embodiment of the invention also applies to kayaks other than the propeller driven kayak discussed herein.

In an alternative embodiment, and particularly where the kayak includes a transom, the drive shaft disposed between the rotatable pedals and the propeller is maintained inside the kayak until the drive shaft reaches an appropriately sized port in the transom and the propeller is maintained behind the transom. Preferably, the propeller is maintained on the rudder.

In another aspect, the present invention provides a kayak comprising: a cockpit containing a seat and a set of rotatable of pedals, the kayak propelled by a propeller, the propeller driven via a linkage by the set of rotatable pedals, the rotatable pedals being mobile fore and aft substantially parallel to a center line of the kayak, and the linkage includes a drive shaft able to be extended and retracted to maintain the transmission of power and rotation from the rotatable pedals to the propeller, and the cockpit is molded into an upper deck of the kayak such that a hip of a user is substantially fully below the upper deck, the cockpit having substantially no overhang in the seat, the gunwales or the front, such that, after capsizing and righting of the kayak in water, substantially no water is retained in the cockpit.

In a further aspect, the present invention provides a watercraft propelled by a propeller or a paddlewheel, the propeller or paddlewheel driven via a linkage by a set of rotatable pedals, wherein the rotatable pedals are mobile fore and aft substantially parallel to a center line of the watercraft, and wherein the linkage includes a drive shaft leading to the propeller, the drive shaft able to be extended and retracted to maintain the transmission of power and rotation from the rotatable pedals to the propeller.

In still a further aspect, the present invention provides a kayak having a cockpit containing a seat, the cockpit molded into an upper deck of the kayak such that a hip of a user is substantially fully below the upper deck, the cockpit sized to fit the user, and the cockpit having substantially no overhang in the seat or in a gunwale or front of the cockpit, such that, after capsizing and righting of the kayak in water, substantially no water is retained in the cockpit.

In still another aspect, the present invention provides a removable insert for a kayak or other watercraft, including kayaks other than those propelled by a propeller, the removable insert sized to fit a cargo hatch in an upper deck of the kayak, the removable insert also sized to permit a child or animal to sit in the removable insert.

These and other aspects of the present invention will become further evident upon reference to the following detailed description and attached drawings. In addition, various references are set forth herein which describe in more detail certain procedures or devices; such references are incorporated by reference in their entirety.

BRIEF DESCRIPTION OF THE DRAWINGS

FIG. 1 is a side elevational view of a kayak having a pedal-powered propulsion system that drives a propeller located near the transom of the kayak.

FIG. 3 also provides a cutaway view through the upper deck of the kayak, revealing the steering system for the kayak.

FIG. 4 depicts a cutaway side elevational view of the hull and cockpit of the kayak.

FIGS. 5A and 5B depict side elevational views of a telescoping drive shaft member, wherein FIG. 5A depicts the member in a shortened position and FIG. 5B depicts the member in an extended position.

FIG. 6 depicts a side elevational view of a pedal tower and gear box attached to the telescoping drive shaft member.

FIG. 7 depicts a side elevational view of an two inserts for the cargo hatches of a kayak where the inserts act as child seats or seats for a pet.

DETAILED DESCRIPTION OF THE INVENTION

Figure 2:
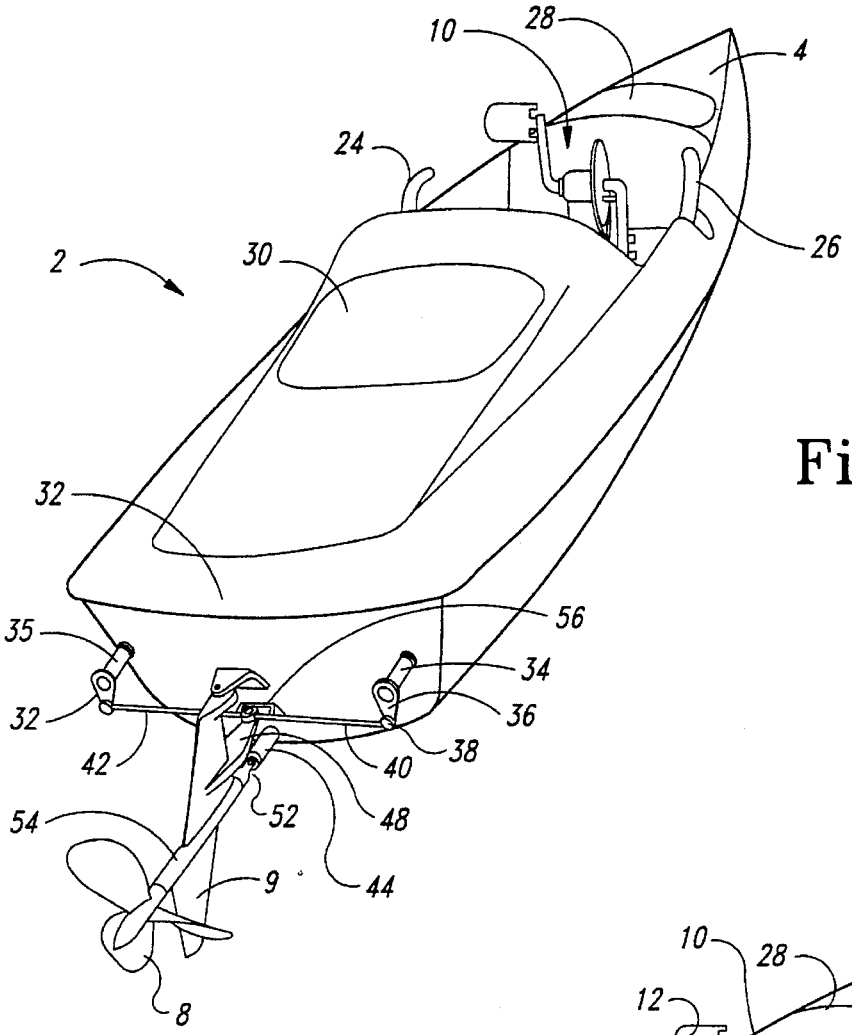
FIG. 2 is a rear side elevational view, giving a foreshortened appearance, of a kayak, wherein the drive shaft exits the kayak through the transom, and the propeller is maintained on the rudder of the kayak.

The present invention provides a pedal-powered kayak wherein the propulsion of the kayak is provided by a propeller. Because a propeller is a significantly more efficient means of providing propulsion than a paddle blade, and because the legs of a user are stronger than the arms of a user, the propulsion system provides a significantly improved, more efficient means of moving a kayak through the water than a traditional paddle. In accordance with this feature of the invention, a user of the kayak tires less easily and is able to reach a desired destination more quickly. Further, the provision of a pedal-propeller propulsion system frees the hands of a user for activities other than providing propulsion while the kayak even though the kayak is underway. Also, due in part to the provision of a traditional kayak shape wherein the hips of a user are substantially fully below the upper deck of the kayak (i.e., the user sits in the kayak as opposed to essentially atop the kayak, such as with traditional surf kayak (or a surfboard)), the present invention provides a heightened stability and a heightened ease of use when compared to a surfboard or a "ocean surfing" type of kayak. Further, the user is relatively protected from the elements, and is not subjected to constant splashing.

FIG. 1 depicts a preferred embodiment of the present invention wherein a kayak 2 having an upper deck 4 and a lower hull 6 that is truncated towards the stem 5 to provide a transom 32. The transom 32 is substantially perpendicular to a center line of the kayak, which line extends through the center of the bow 3 of the kayak and exits the center of the stern 5 of the kayak. Preferably the transom is slightly rounded. The bow 3 is preferably pointed. As can be seen, the kayak is streamlined in shape, and the overall width of the kayak is typically no greater than about one-fifth to one-seventh of the overall length of the kayak, and preferably is about one-sixth of such overall length. The kayak is generally about 24 inches to about 36 inches in width, typically about 26 inches to about 30 inches in width, and preferably about 27 inches in width. The kayak is generally about 16 feet to about 20 feet in length, typically about 17 feet to about 19 feet in length, and preferably about 18 feet in length. In preferred embodiment, the hull of the kayak 2 is shaped such that the kayak can maintain a cruising speed of at least about 6 miles per hour, and preferably at least about 7 miles per hour, when the pedals are rotated at about 68 rpm to give a propeller rotation of about 520 rpm, and the propeller has three blades, each with a pitch of about 14 inches, a width of about 1.75 inches, and a length of about 4 inches to provide a diameter of about 8.5 inches.

The upper deck 4 of the kayak preferably has a fore cargo hatch 28 and an aft cargo hatch 30, each located about either end of a cockpit 20 that is typically centrally located in the kayak and is sized to fit a user. In the embodiment shown, only a cockpit for a single user is provided, but the present invention includes multi-user kayaks having cockpits suitable for two or more users. In such a multi-user cockpit, the users are preferably situated in a line, but could also be situated side by side, provided that the overall streamlined nature of the kayak was not destroyed.

Within the cockpit 20 are rotatable pedals 10 connected via a linkage to propeller 8, the linkage in a preferred embodiment includes a chain attached to a gear box, which is in turn attached to an extensible and retractable drive shaft, the drive shaft having the propeller attached at a stem end. Alternative methods and devices for linking the pedals and the propeller, while lesser preferred, will be apparent to those of skill in the art, in light of the present specification. Returning to FIG. 1, the rotatable pedals 10 have a set of pedals 12 and a gear 14. The rotation of the pedals 12 by the feet of the user transmits power and motion via the gear 14 to chain 16, which connects to a gear box, discussed below. The gear box transmits the power from the pedals 12 to the propeller 8. The pedals 12, gear 14, and chain 16 are supported by a pedal support 18, the pedal support preferably a tower. Located to the aft of the rotatable pedals 10 in the cockpit 20 is a seat 22. In a preferred embodiment, the seat is molded into the upper deck 4 of the kayak 2, and allows the user to operate the kayak from a semi-reclined position. To the left and right (i.e., port and starboard, respectively) of the cockpit 20, and protruding through the upper deck 4, are left handle 24 and fight handle 26, which are used for steering. The handles are connected to rudder 9, preferably through a series of rigid, elongated elements such as tubes and connecting rods, although a cable and pulley system may also be used, and other suitable systems for manipulating rudder 9 will be readily apparent to those of skill in the art.

Figure 3:
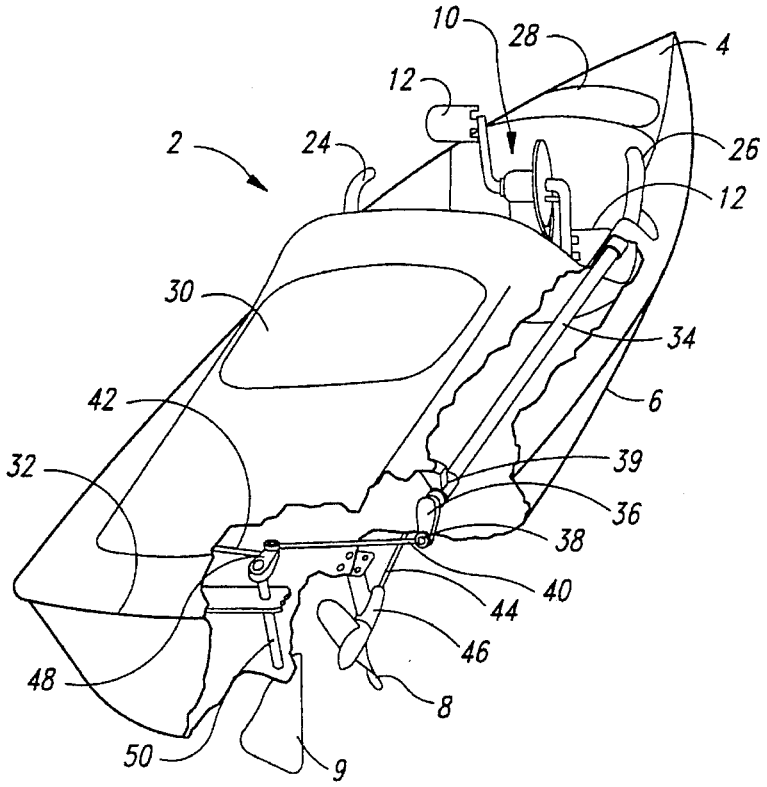
FIG. 3 depicts a rear, side elevational view, giving a foreshortened appearance, of a kayak wherein the drive shaft exits the underside of the hull of the kayak, and the propeller is located in front of the rudder.

FIG. 3 provides a foreshortened view of a kayak 2 according to the present invention, wherein a preferred embodiment of the steering mechanism is depicted. This steering mechanism is also suitable for use with watercraft other than the propeller-driven kayak discussed herein, and may also be used with still other vehicles that require a steering system. The steering mechanism depicted is the right-hand control, but an equivalent control is preferably provided for the left-hand side of the kayak as well. Turning to the steering mechanism itself, right handle 26 is attached to a first end of a fight rigid, elongated element 34. In a preferred embodiment, the handle is shaped the same as a handle commonly found attached to the handlebars of a mountain bike. The right handle 26 is typically attached via traditional mechanical devices such as a screw, rivet or glue, to right rigid, elongated element 34. From right handle 26, the right rigid, elongated element 34 extends aft substantially parallel to the center line of the kayak 2. In a preferred embodiment, the right rigid, elongated element 34 is a hollow aluminum tube, or is otherwise made of a lightweight material capable of transmitting rotational motion without significant deformation of the material. Typically, the right rigid, elongated element 34 is supported near its second, or stern, end, such as by bracket 39 having a tubular holding portion.

Attached to the second end of the right rigid, elongated element 34 is a right first connector 36. The right first connector permits the right connecting rod 40 to be attached to the right rigid, elongated element 34 at a point 38 displaced from the central axis of the right rigid, elongated element 34. Because of such displacement, upon rotation of the right rigid, elongated element 34, the point 38 moves back and forth. Right connecting rod 40 is, in turn, connected between the right first connector 36 and a second connector 48, the second connector 48 being an extension of the rudder 9. More particularly, the second connector 48 is attached to rudder 9 via a rod 50, and the right connector 48 provides a displaced attachment point, similar to point 38, such that movement back and forth of the attachment point creates rotational movement in the rod 50 and movement of rudder 9, thereby manipulating the angle of rudder 9 relative to the center line of the kayak.

A corresponding set of rigid, elongated elements, rods and connectors are located on the left-hand side of the kayak, although only the second end of the left connecting rod 42 is depicted in FIG. 3. Below the underside of the kayak 2 is the drive shaft 44, which has extended through the lower hull 6 of the kayak to the propeller 8. In a preferred embodiment, the drive shaft is maintained within a strut 46 having a tubular holding portion through which the drive shaft 44 passes. In .K another preferred embodiment, as depicted in FIG. 1, a fin 7 is located on the lower hull 6 and in front of the propeller 8, to protect the propeller from debris. In a further preferred embodiment, the fin is an extension of strut 46.

FIG. 2 depicts an alternative embodiment of the present invention wherein drive shaft 44 extends through the aft portion of kayak 2 without passing through the lower hull of kayak 2 until the drive shaft 44 reaches the transom 32. A tier passing through the transom 32, the drive shaft 44 is connected via a propeller universal joint 52 to the propeller 8. Flexible joints other than universal joints may also be suitable for use with the present invention, both at the connection of the drive shaft and the propeller and at other locations throughout the kayak. In a preferred embodiment, the propeller passes through a tube 54 sized to fit the drive shaft of the propeller, and maintained within the rudder 9. The propeller 8 may be maintained at or below the water level pursuant to this embodiment. The steering mechanism of the embodiment depicted in FIG. 2 is essentially the same as in the embodiment depicted in FIG. 3, except that fight rigid, elongated element 34 extends through the transom, as does left rigid, elongated element 35. Rotational motion is transmitted from the left and right rigid, elongated elements to the connecting rods 42 and 40, and thus to connector 48, which, in a preferred embodiment, moves back and forth between a guide 56. In a preferred embodiment, solely rigid components are used throughout the steering mechanism, thus allowing steering to be performed with either hand, such that manipulation of either the right handle 26 or the left handle 24 results in a corresponding manipulation of the rudder 9 in any direction. Although lesser preferred, non-rigid materials may be used, although typically this results in each hand only moving the rudder in one direction.

FIG. 4 depicts a cutaway side view of a preferred embodiment of the upper deck 4 and the lower hull 6 of the present invention. In this preferred embodiment, upper deck 4 has a cockpit 20 including a stationary seat 22. The seat 22 has a seat back 64 and a seat bottom 66. The cockpit 20 also has a gunwale 60 and a front 61. Preferably, the cockpit 20 is molded into the upper deck such that the lowest point(s) of the cockpit contact the inner surface of the lower hull 6, and further preferably the seat bottom 66 is located below the waterline of the kayak, typically within about 1 inch to about 1.5 inches from the lower hull 6. Locating the seat bottom below the waterline is also preferred even when the seat is not molded into the upper hull 6. Although not depicted in FIG. 4, it is also preferred to provide a support between lower hull 6 and seat bottom 66.

The components of the cockpit 20 are preferably formed without any significant overhangs or ridges, such that upon capsizing and righting of the kayak in water, substantially no water is retained by the cockpit, even when the weight of a user is pressing down on the kayak throughout the righting of the kayak (and cockpit). Further preferably, the seat is molded into the upper deck 4 such that there is no space behind seat 22, as shown in FIG. 4, and thus there is a reduced capacity for water retention in the event the kayak capsizes. Such a design greatly facilitates reentry into the kayak by the user in comparison to traditional paddle-driven kayaks: Traditional kayaks typically include a significant "rim" surrounding the cockpit that retains water while the kayak is righted, and traditional kayaks typically have an "apron" that physically connects the user to the sides of the cockpit (and the apron must be taken off when the kayak is capsized, then put back on before the user is again secured in the kayak), but there is typically no need for such an apron with the present kayak. This aspect of the present invention applies to traditional kayaks, provided that the seat for the user is deeply enough set into the kayak that the hips of the user are below the top of the upper deck 4. Further, the cockpit is preferably set deeply enough into the kayak such that the seat back 64 provides support to the back of the user, as opposed to a depression in the upper hull that is essentially merely for holding the buttocks of a user. In a preferred embodiment, the cockpit 20 and other structural components of the cockpit are molded into the upper deck 4 and therefore there is no need for attaching devices such as screws, rivets or glue.

The upper deck 4 also has a cargo hatch 58 located fore of the cockpit 20. At the lower hull 6 of the kayak a sheath 62 permits passage of the drive shaft 44 to the propeller without allowing water into the kayak 2.

It is a feature of the present invention that the rotatable pedals 10 can be moved fore and aft, and this feature of the present invention applies to watercraft other than kayaks. Such alternative watercraft include those propelled by a propeller or a paddlewheel. FIGS. 5A and 5B depict one portion of a preferred means for attaining such mobility of the rotatable pedals 10, as the Figures depict an extendible and retractable drive shaft member 68 that can be releasably maintained or secured in both shortened (FIG. 5A) and extended (FIG. 5B) positions (as well as any desired position in between). Preferably, the drive shaft member 68 telescopes. Turning to the telescoping drive shaft member 68 depicted in FIGS. 5A and 5B, a drive shaft attachment 70 is connected via a drive shaft universal joint 72 to an internal telescoping member 74. In a preferred embodiment, the internal telescoping member is of a non-circular configuration, such as square, hexagonal, triangular or splined, so that rotational force applied to either the internal telescoping member 74 or the external telescoping member 76 will be transferred from one to the other without slippage. Of course, other means for providing an extendible drive shaft member are known in the art, including the provision of a cylindrical rod within a sheath (open or closed) along with a screw or nut that can clamp down and hold the cylindrical rod in position. Internal telescoping member 74 is maintained inside external telescoping member 76, which is, in turn, attached via gear box universal joint 78 to gear box attachment 80.

FIG. 6 depicts the telescoping drive shalt member of FIG. 5 attached to rotatable pedals 10. In particular, gear box attachment 80 passes into gear box 82 wherein bevel gears are located and transmit power and rotation at a substantially perpendicular angle from a chain connected to the rotatable pedals to drive shaft 44 and propeller 8. In a preferred embodiment, the bevel gears have a 1:1 ratio. In another preferred embodiment, the linkage does not include a flexible drive belt, such as a round plastic belt or a chain, that transmits power and rotation at a substantially perpendicular angle, or at any other angle than about 0° or 180°. Bevel gears are known in the art and need not be described in detail here. Gear box drive shaft 84 extends from gear box 82 towards the chain 16. Chain 16 connects gear 14 to gear box drive shaft 84, and thus rotation of pedals 12 (connected via crank arm 88 to gear 14) results in transmission of power and rotation to the propeller. Gear 16 may also be located in a cluster of gears, to provide a variable ratio of pedal rotation speed to propeller rotation speed. Plate 86 located at the base of the pedal support 18 preferably has slots 92 located therein, thus facilitating fore-and-aft mobility of the pedal support while permitting the pedal support to be releasably secured at a desired position.

FIG. 7 depicts another aspect of the present invention, which is an insert for a cargo hatch in a kayak. This aspect of the present invention applies to all types of kayaks. In FIG. 7, fore cargo insert 96 and aft cargo insert 98 are sized to fit fore cargo hatch 58 and aft cargo hatch 94. Typically, each of the cargo inserts has a rim 100, a leg space 102, and a child seat 104. In a preferred embodiment, the insert does not substantially protrude under upper deck 4, thereby facilitating release of the occupant in the event of capsizing. However, a minor amount of protrusion under the upper deck can be preferable, as additional space may be thereby provided for the occupant. The amount of protrusion under the upper deck 6 becomes substantial when the protrusion significantly interferes with the release of the occupant upon capsizing.

Typically, a gasket is located under rim 100 to provide a watertight seal between the insert and the rim of the cargo hatch. Although lesser preferred, the gasket may also be maintained on the rim of the cargo hatch. Typically, the insert will be releasably secured within the cargo hatch using the same devices that secure the cargo hatch cover, such as fore cargo hatch cover 28 and aft cargo hatch cover 30. Such devices can include clips, screw-down wing nuts, or plastic members that can be swung over the hatch for sealing, and away from the hatch for release of the insert and/or cargo hatch cover.

The inserts of the present invention are particularly advantageous over an open cargo hatch with no insert because the inserts prevent the occupant from contacting raw fiberglass, prevent a child (or pet) from crawling into the covered cargo space, where the child can become trapped, and prevent water from entering the general cargo space, which water may be extremely difficult to remove upon capsizing in the middle of a body of water. The provision of an aft cargo insert 98 for aft cargo hatch 94 is particularly preferred where the kayak has a transom 32, as such transom results in greater insert area (and/or cargo area) behind the cockpit.

From the foregoing, it will be appreciated that, although specific embodiments of the invention have been described herein for purposes of illustration, various modifications may be made without deviating from the spirit and scope of the invention. Accordingly, the invention is not limited except as by the appended claims.

I claim:

1. A monohull water craft comprising a kayak having a cockpit containing a seat located such that a hip of a user is substantially fully below an upper deck of said kayak, said cockpit also containing a set of rotatable pedals, said kayak propelled by a propeller that is driven via a linkage by said set of rotatable pedals, wherein said set of said rotatable pedals is mobile fore and aft substantially parallel to a center line of said kayak, and wherein said linkage includes a drive shaft leading to said propeller, said drive shaft able to be extended and retracted to maintain the transmission of power and rotation from said rotatable pedals to said propeller.

2. The kayak of claim 1 wherein said cockpit containing said seat is molded into an upper deck of said kayak such that said cockpit has substantially no overhang in said seat or in a gunwale or front of said cockpit, whereby, after capsizing and righting of said kayak in water, substantially no water is retained in said cockpit.

3. A monohull water craft comprising a kayak having a cockpit containing a seat located such that a hip of a user is substantially fully below an upper deck of said kayak, said cockpit also containing a set of rotatable pedals, said kayak propelled by a propeller that is driven via a linkage by said set of rotatable pedals, a stern of said kayak being truncated behind said seat substantially perpendicular to a center line extending along said kayak to provide a transom, wherein a drive shaft disposed between said rotatable pedals and said propeller is maintained inside said kayak until said drive shaft reaches a port in said transom, said port sized to fit said drive shaft, and wherein said propeller is maintained behind said transom.

4. The kayak of claim 3 wherein said propeller is maintained on a rudder.

5. The kayak of claim 3, further comprising:

a right handle located on a right side of said seat, said right handle protruding through an upper deck of said kayak, said right handle attached at a first end of a right rigid, elongated element running substantially parallel to a center line of said kayak, a second end of said right rigid, elongated element attached to a first end of a right connecting rod, said right rigid, elongated element connected to said right connecting rod at a first point away from the central axis of said right rigid, elongated element, such that upon rotation of said right rigid, elongated element said connecting rod is moved closer to or away from said center line of said kayak, said right connecting rod attached at a second end to a rudder and capable of manipulating the angle of said rudder relative to said center line; and a left handle located on a left side of said seat, said left handle protruding through said upper deck, said left handle attached at a first end of a left rigid, elongated element running substantially parallel to said center line, a second end of said left rigid, elongated element attached to a first end of a left connecting rod, said left rigid, elongated element connected to said left connecting rod at a second point away from the central axis of said left rigid, elongated element, such that upon rotation of said left rigid, elongated element said connecting rod is moved closer to or away from said center line, said left connecting rod attached at said second end to said rudder and capable of manipulating the angle of said rudder relative to said center line.

6. A kayak comprising:

a cockpit containing a seat, said cockpit molded into an upper deck of said kayak such that a hip of a user is substantially fully below said upper deck, said cockpit having substantially no overhang, such that after capsizing and righting of said kayak in water substantially no water is retained in said cockpit;

a set of rotatable pedals contained within said cockpit and mobile fore and aft substantially parallel to a center line of said kayak; and a propeller for moving said kayak, said propeller driven via a linkage by said set of rotatable pedals, said linkage including a drive shaft able to be extended and retracted to maintain the transmission of power and rotation from said rotatable pedals to said propeller.

7. The kayak of claim 6, further comprising:

a right handle located on a right side of said seat, said right handle protruding through an upper deck of said kayak, said right handle attached at a first end of a right rigid, elongated element running substantially parallel to a center line of said kayak, a second end of said right rigid, elongated element attached to a first end of a right connecting rod, said right rigid, elongated element connected to said right connecting rod at a first point away from the central axis of said right rigid, elongated element, such that upon rotation of said right rigid, elongated element said connecting rod is moved closer to or away from said center line of said kayak, said right connecting rod attached at a second end to a rudder and capable of manipulating the angle of said rudder relative to said center line; and a left handle located on a left side of said seat, said left handle protruding through said upper deck, said left handle attached at a first end of a left rigid, elongated element running substantially parallel to said center line, a second end of said left rigid, elongated element attached to a first end of a left connecting rod, said left rigid, elongated element connected to said left connecting rod at a second point away from the central axis of said left rigid, elongated element, such that upon rotation of said left rigid, elongated element said connecting rod is moved closer to or away from said center line, said left connecting rod attached at said second end to said rudder and capable of manipulating the angle of said rudder relative to said center line.

8. A kayak comprising:

a cockpit containing a seat and a set of rotatable of pedals, said kayak propelled by a propeller connected via a linkage to said set of rotatable pedals and wherein said propeller is rotated by said set of rotatable pedals;

a right handle located on a right side of said seat, said right handle protruding through an upper deck of said kayak, said right handle attached at a first end of a right rigid, elongated element running substantially parallel to a center line of said kayak, a second end of said right rigid, elongated element attached to a first end of a right connecting rod, said right rigid, elongated element connected to said right connecting rod at a first point away from the central axis of said right rigid, elongated element, such that upon rotation of said right rigid, elongated element said connecting rod is moved closer to or away from said center line of said kayak, said right connecting rod attached at a second end to a rudder and capable of manipulating the angle of said rudder relative to said center line; and a left handle located on a left side of said seat, said left handle protruding through said upper deck, said left handle attached at a first end of a left rigid, elongated element running substantially parallel to said center line, a second end of said left rigid, elongated element attached to a first end of a left connecting rod, said left rigid, elongated element connected to said left connecting rod at a second point away from the central axis of said left rigid, elongated element, such that upon rotation of said left rigid, elongated element said connecting rod is moved closer to or away from said center line, said left connecting rod attached at said second end to said rudder and capable of manipulating the angle of said rudder relative to said center line.

9. A steering system for a watercraft, comprising:

a right handle located on a right side of a seat of said watercraft, said right handle attached at a first end of a right rigid, elongated element running substantially parallel to a center line of said watercraft, a second end of said right rigid, elongated element attached to a first end of a right connecting rod, said right rigid, elongated element connected to said right connecting rod at a first point away from the central axis of said right rigid, elongated element, such that upon rotation of said right rigid, elongated element said connecting rod is moved closer to or away from said center line of said watercraft, said right connecting rod attached at a second end to a rudder and capable of manipulating the angle of said rudder relative to said center line; and a left handle located on a left side of said seat, said left handle attached at a first end of a left rigid, elongated element running substantially parallel to said center line, a second end of said left rigid, elongated element attached to a first end of a left connecting rod, said left rigid, elongated element connected to said left connecting rod at a second point away from the central axis of said left rigid, elongated element, such that upon rotation of said left rigid, elongated element said connecting rod is moved closer to or away from said center line, said left connecting rod attached at said second end to said rudder and capable of manipulating the angle of said rudder relative to said center line.

* * * * *